United States Patent [19]

Jundt et al.

[11] 4,174,696

[45] Nov. 20, 1979

[54] IGNITION SYSTEM

[75] Inventors: Werner Jundt, Ludwigsburg; Bernd Bodig, Leinfelden; Heinz Decker, Vaihingen; Günther Schmidt; Bert Wurst, both of Ludwigsburg; Karl Seeger, Ditzingen; Herman Roozenbeek, Schwieberdingen, all of Fed. Rep. of Germany

[73] Assignee: Robert Bosch GmbH, Stuttgart, Fed. Rep. of Germany

[21] Appl. No.: 869,627

[22] Filed: Jan. 16, 1978

[30] Foreign Application Priority Data

Jan. 19, 1977 [DE] Fed. Rep. of Germany ..... 2701968
Oct. 19, 1977 [DE] Fed. Rep. of Germany ..... 2746885

[51] Int. Cl.[2] ..... F02P 5/04
[52] U.S. Cl. ..... 123/148 E; 123/117 R
[58] Field of Search ..... 123/148 E, 117 D, 117 R

[56] References Cited

U.S. PATENT DOCUMENTS

| | | | |
|---|---|---|---|
| 4,018,202 | 4/1977 | Gardner | 123/117 D |
| 4,041,912 | 8/1977 | Sessions | 123/148 E |
| 4,088,106 | 5/1978 | Borst et al. | 123/148 E |
| 4,112,890 | 9/1978 | Manger et al. | 123/148 E |

FOREIGN PATENT DOCUMENTS

| | | | |
|---|---|---|---|
| 2418177 | 11/1974 | Fed. Rep. of Germany | 123/148 E |
| 2352694 | 10/1975 | Fed. Rep. of Germany | 123/148 E |
| 2523388 | 12/1976 | Fed. Rep. of Germany | 123/117 R |

*Primary Examiner*—Charles J. Myhre
*Assistant Examiner*—Raymond A. Nelli
*Attorney, Agent, or Firm*—Frishauf, Holtz, Goodman & Woodward

[57] ABSTRACT

A switch connected in series with the ignition coil is "on" and "off," respectively, in the presence and absence of a pulse furnished by a pulse generator operating in synchronism with the crankshaft of the engine. If the pulse width of the pulses is too small for the current in the ignition coil to reach the minimum value required for ignition, the closing time of the series switch is advanced, while if the pulse width is too long, causing excess heat dissipation in the coil, the closing time of the switch is retarded. To accomplish this, a first digital counter counts downwards for a predetermined time and upwards for a time period in which the current in the ignition coil exceeds a predetermined current. Upon interruption of the current in the coil, the then-present value in the first digital counter is transferred to a second digital counter. The second counter then counts down at a predetermined rate until a predetermined count is reached. At this time, the series switch is switched to the conductive state.

26 Claims, 6 Drawing Figures

IGNITION SYSTEM

The present invention relates to ignition control systems and more particularly to ignition control systems wherein a sequence of ignition pulses is furnished by a pulse generator operating in synchronism with the crankshaft of an internal combustion engine.

BACKGROUND AND PRIOR ART

If the time that the ignition current flows through the ignition coil is determined solely by the pulse width of the pulses furnished by the above-described pulse generator, the pulse width may be too narrow to allow the current through the coil to reach the minimum value required for ignition or, if the pulse width is too wide, the current may flow for too long a time prior to ignition, thereby generating unnecessary heat losses, and decreasing the lifetime of a number of components.

Ignition systems are known, for example from German Disclosure Document DE-OS No. 2,448,675 or U.S. Pat. No. 3,587,551, in which some decrease of the undesired losses is achieved by limiting the current through the primary coil to the minimum value required for ignition until ignition takes place. This assures that the energy at ignition will always be the same, but does not decrease the losses described above.

It is an object of the present invention to provide an ignition control system wherein the closure of the series switch is controlled to assure the fact that the ignition current will have the necessary amplitude for ingition, but will not flow unnecessarily long prior to the ignition time. This object is to be accomplished regardless of variations in supply voltage, caused, for example, by changes in the charge of the battery, or changes in the parameters of the various components caused, for example, by temperature changes.

SUMMARY OF THE INVENTION

Briefly, the present invention relates to an ignition system having spark creating means, for example an ignition coil and at least one spark plug connected thereto, and controllable switch means, for example a transistor, connected to said spark creating means for permitting and blocking current flow through said spark creating means when in a first and second state (conductive and nonconductive) respectively. The ignition system further has means for furnishing a sequence of first ignition signals, each for timing the furnishing of a spark. The ignition control system in accordance with this invention comprises means for switching said controllable switch means to said second state under control of said first ignition signals. It further comprises first storage means, for example a first digital counter, for furnishing a first storage signal. First storage signal changing means are provided for changing said first storage signal in a first direction for a predetermined time period and in a second direction opposite to said first direction for a time period corresponding to the time the current in said spark creating means exceeds a predetermined threshold value. A current-dependent first storage signal is thus created. Second storage means, for example a second digital counter, is provided. The second storage means furnish a second stored signal. Transfer means are provided for transferring the current-dependent first storage signal to the second storage means under control of the first ignition signal, thereby creating a current-dependent second storage signal. Further, second storage signal changing means are provided which continually change said second storage signal in a predetermined direction. For example, the second storage signal changing means is a clock pulse generator whose output is connected to the counting input of the second digital counter and the second digital counter is enabled when the ignition current is interrupted. When the count on the second digital counter reaches a predetermined threshold value, switch control means, for example a flip-flop 24, cause the series switch to close, thereby permitting flow of ignition current.

The predetermined time period during which the first storage changing means change the first storage signal in a first direction is, for example, the time required for the current in the spark creating means to reach a predetermined threshold value. The change in the second direction begins at the end of the change in the first direction and ends at the ignition time. The results in a particularly simple embodiment of the present invention.

In a further preferred embodiment, the predetermined time period in which the first storage signal changing means change the first storage signal in a first direction is determined by the time required for the second storage signal to change from a first to a second predetermined value during its counting process. Here too, the change in the second direction commences when the current in the spark furnishing means has reached a predetermined current and ends at the ignition time. This solution has the advantage that the time during which ignition current flows can be corrected if the stored energy in the coil has not been completely discharged by the spark. A complete utilization of the energy stored in the coil by regulation of the time over which a constant current flows in the coil results.

It is further advantageous to avoid the flow of quiescent current while the engine is at rest. For this purpose, a third storage means is provided. The stored value in the third storage means is changed continuously and is reset at the ignition time. A comparator is connected to the third storage means which, upon crossing of a predetermined threshold value, furnishes a control signal which results in the interruption of current through the ignition coil.

The invention will be described by way of example with reference to the accompanying drawings, wherein:

FIG. 1 is a circuit diagram of a first embodiment of the present invention,

FIG. 2 a diagram showing the variation of signal with respect to time at selected points in the circuit of FIG. 1;

Figure 1:
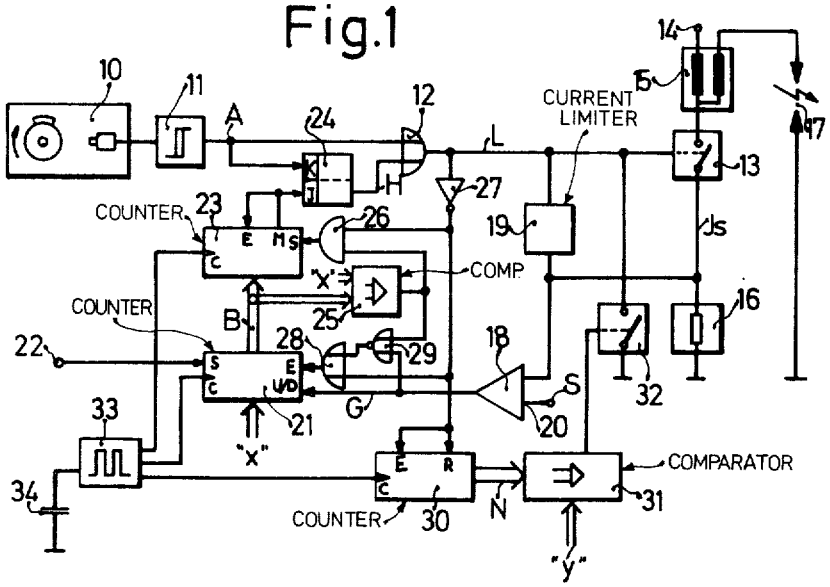

In FIG. 1, a pulse generator coupled to the crankshaft of an engine is shown schematically in a box 10. A pulse former stage 11, preferably a Schmitt triger circuit, is connected to pulse generator 10. Units 10 and 11 together constitute means for furnishing a sequence of first ignition signals. In FIG. 1 this means is shown as a Hall generator which furnishes an ignition signal having a pulse width corresponding to a predetermined angle of rotation of the crankshaft. However, this means can equally well be embodied in a circuit breaker or in a contactless pulse generator. Further, embodiments are possible, wherein, for example, a pulse is generated at the beginning and end of a predetermined angle of rotation of the crankshaft. These pulse can then be applied to a bistable stage. The unit 10 can also contain circuitry for varying the ignition time in dependence on various engine parameters such as, for example, the speed of the engine. Such ignition time regulators are well known both in mechanical and electronic form.

The output of pulse forming stage 11 is connected through an OR gate 12 with a control input of controllable switch means, here a controllable semiconductor 13. If required, a power output stage can be interconnected between the output of OR gate 12 and the control input of switch 13. A terminal 14 is connected to the positive terminal of the supply voltage. Between terminal 14 and ground potential is connected a series circuit including the primary winding of the ignition coil 15, the controlled circuit of switch 13, and a resistor 16 which serves as a current measuring means. A series circuit including the secondary winding of coil 15 and a spark plug 17 is connected between the common point of the primary winding of coil 15 and switch 13 on the one hand and ground potential on the other hand. Spark plug 17 is to be considered as representative of either a single spark plug or a plurality of spark plugs operatively associated with a distributor.

One terminal of resistor 16 is connected to the input of a threshold stage 18 which is a comparator. This terminal of resistor 16 is also connected through a current limiter circuit 19 with a control input of switch 13. Such current limiter stages are well known from the above named prior art publications and operate to vary the resistance of the controlled circuit of switch 13 which, for example, is a transistor, in such a manner that the current through the primary winding of the ignition coil does not exceed the current $I_s$ which is required for proper ignition. A second input of comparator 18 is connected to a terminal 20 which receives a reference voltage S. The reference voltage is so adjusted, that comparator 18 furnishes a comparator output signal when the primary current $I_s$ reaches one half of the value required for ignition.

The output of comparator 18 is connected to the direction control input of the first storage means, here a digital counter 21 which holds the count state in which it is, or has been, placed until change in its setting, or counting, is commanded. Counter 21 has a set input S. Application of a signal to terminal 22, connected to the set inputs causes the counter to be set to the value indicated by "x" which, for example, may be the number 100. This number may be hard wired into the system. Terminal 22 receives a signal causing counter 21 to be set to the number "x" when the system is first put into operation. The counting outputs of counter 21 are connected to the inputs of second storage means, here a digital counter 23. This counter in the embodiment shown in FIG. 1 is a down counter whose carry output m is connected to an input E which blocks the operation of the counter when receiving a "1" signal. The M output is further connected to the J input of a flip-flop 24 whose output is connected to the second input of OR gate 12. The output of pulse former 11 is connected to the K input of flip-flop 24.

The counting outputs of first counter 21 are further connected with the counting inputs of a digital comparator 25. A second input of digital comparator 25 receives the "x" signal which is hard wired. The output of comparator 25 is connected to the set input of counter 23 through an AND gate 26. The output of OR gate 12 is connected through an inverter 27 to a further input of AND gate 26. Further, the output of inverter 27 is connected to the blocking input E of counter 21 through an OR gate 28. The output of digital comparator 25 is connected to a further input of OR gate 28 through a NOR gate 29. A further input of NOR gate 29 is connected to the output of comparator 18.

Blocking input E as well as a reset input R of a third counter 30 are connected to the output of inverter 27. The counting outputs of counter 30 are connected to the input of a second digital comparator 31. The reference input to comparator 31 is indicated by "Y" which again is hard wired into the system. The output of comparator 31 is connected to the control input of a switch 32. The output side of switch 32 causes the control input of switch 13 to be connected to ground potential. Units 30–32 serve to prevent the flow of quiescent current while the engine is at rest.

A clock generator 33 has outputs connected to the counting inputs C of counters 21, 23 and 30. The count on each of the counters is thus changed at a rate determined by the frequency of clock pulse generator 33. The same frequency may be used throughout, but different frequencies may be derived from clock generator 33 by known frequency dividers. The frequency of clock generator 33 is adjustable by means of a capacitor 34 which is generally provided as an external adjustment part. It is connected between an externally available terminal of clock generator 33 and ground potential. It is also possible if it is sufficiently small that this capacitor be integrated into the system, allowing a complete ignition system to be furnished as one integrated circuit block. The pulses derived from clock pulse generator 33 also serve to synchronize the operation of the system.

Figure 2:
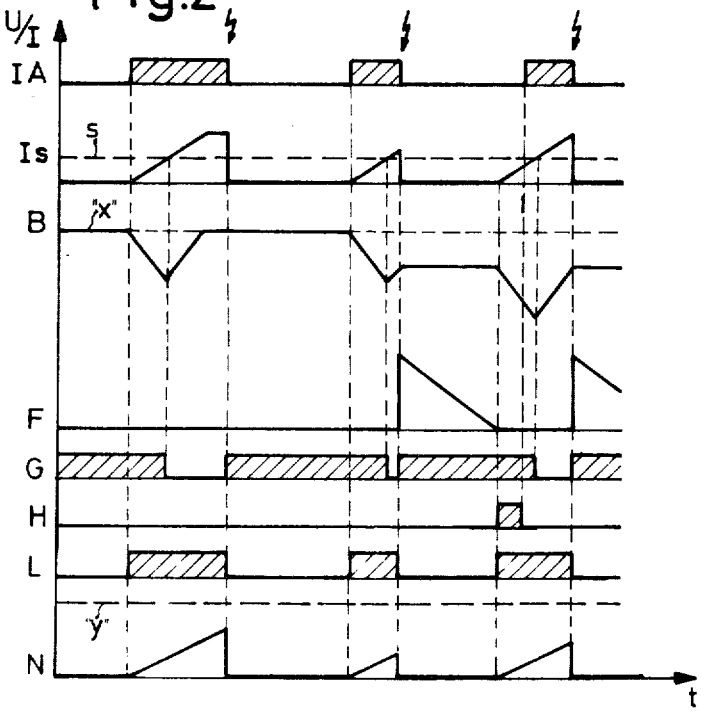

Operation, with reference to FIG. 2. First, it should be mentioned that the "0" signals and "1" signal mentioned herein signify signals at a first and second predetermined potential respectively. Specifically, the "0" signal signifies a signal at approximately ground potential, while a "1" signal is approximately equal to the supply voltage.

A signal from the ignition signal furnishing means 10 is shaped into a rectangular signal A in the pulse former stage 11. A flip-flop 24 is reset by the signal A (if previously set). Further, the signal A is applied to one input of an OR gate 12 whose output is connected to the controllable switch means 13. Switch 13, which, in a preferred embodiment, is a transistor, is conductive while the signal A is applied to its control electrode (base). For the apparatus of FIG. 1, the pulse width of signal A constitutes the minimum time which switch 13 will be conductive. It thus also constitutes the minimum time during which current will flow through the primary winding of ignition coil 15. The current $I_s$ ignition coil 15 increases until it is either maintained at a constant value by current limiter stage 19 or until it is interrupted at the end of signal A. When the current is interrupted, the spark is created at spark plug 17. In the presence of signal A, the blocking input E of counter 21 receives a negative signal through OR gate 28 and therefore counts.

Counter 21 was previously set to the value "x" by the signal which energized the apparatus. The signal caused a voltage to appear in terminal 22, thereby setting counter 21. At the start of signal A, counter 21 starts to count in the down direction, since a "1" signal is at the output of comparator 18. Comparator 18 is so set, that its output changes from a "1" signal to a "0" signal when the current in the primary winding of the ignition coil reaches one half of the value required for ignition. At this point counter 21 changes its counting direction and starts to count in the up direction. In the first cycle shown in FIG. 2, counter 21 reaches the value "x" again before the end of signal A. The counter is stopped at this point, since comparator 25 furnishes a "0" signal and, simultaneously, the "0" signal is still present at the output of comparator 18. NOR gate 28 therefore furnishes a "1" signal which, through OR gate 28 blocks counter 21. The "0" output of comparator 25 further prevents the setting of counter 23 at the end of signal A, that is at the time the ignition signal is applied to switch 13.

The second cycle is indicative of an acceleration since the duration of signal A is decreased. Counter 21 therefore has not reached the value "x" at the end of signal A. However, counter 21 is blocked at this time by the "1" signal at the output of inverter 27. The "1" output of inverter 27 also causes counter 23 to be set to the then-present value of counter 21. Counter 23 is no longer blocked, and starts to count in the downwards direction. When it reaches its lowest possible count, a "1" signal appears at the carry output M which causes counter 23 to be blocked and flip-flop 24 to be set. The resulting signal H at the output of flip-flop 24 causes switch 13 to close at an earlier time than the start of the signal A. This advance in the closing time causes the current prior to ignition to increase towards the desired value. This process is repeated in the third cycle. Counter 21 again reaches the same count as in the second cycle since the speed of the engine is assumed not to have changed.

For the embodiment of FIG. 1, counter 23 is not set if the angle of closure of switch 13 as determined by the pulse width of signal A is too large. If, however, it is too small, the count in counter 21 is less at ignition time than "X" and the time switch 13 is open is determined by counter 23. This time is shorter, the less the count on counter 21 at ignition time.

In a simplier embodiment, digital comparator 25 may be omitted. The maximum time switch 13 is open is then determined by the capacity of counter 21. An increase in the counter capacity does have the drawback that under extreme conditions, the time that switch 13 is closed may be too short. Further, current limiter 19 may be omitted if increases of primary current in the ignition coil beyond the required value are acceptable.

If the rotating shaft which controls the furnishing of the ignition signal comes to rest at a point at which flip-flop 24 happens to be set, a quiescent primary current would flow in the ignition coil. In order to prevent this, a third counter 30 is furnished which counts in an upward direction during the time that switch 13 is closed. At each ignition time, counter 30 is reset over its reset input R. The threshold value Y of a comparator 31 connected to the output of counter 30 is adjusted in such a manner that during rotation of the shaft even at very low speeds the count of Y will not be reached. The output of comparator 31 during operation of the engine is therefore a "0" signal. If, however, the shaft is not rotating, counter 30 does not receive a reset signal and its count N increases over the threshold value Y. The output of comparator 31 then changes from a "0" to a "1" signal causing the control electrode of switch 13 to be connected to ground potential through switch 32. This causes switch 13 to open, thereby interrupting the current through the primary winding of ignition coil 15.

Figure 3:
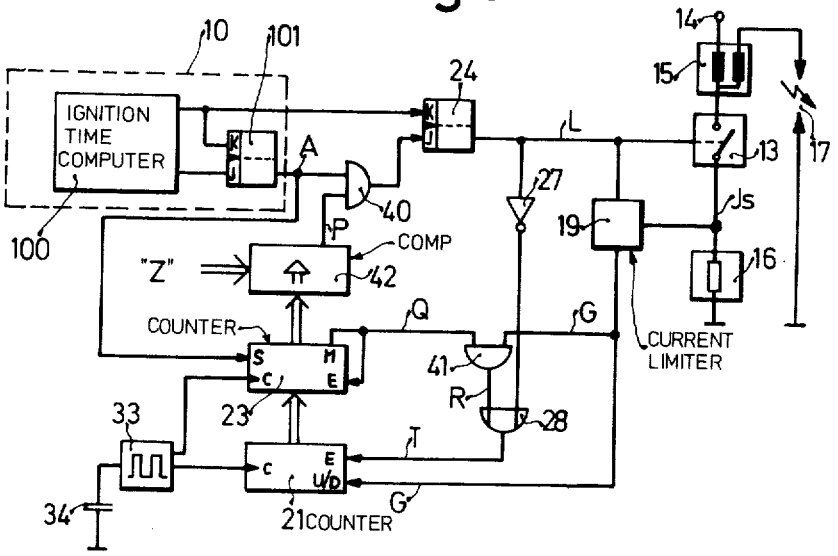
FIG. 3 is a circuit diagram of a second preferred embodiment of the present invention.

A second embodiment of the present invention is shown in FIG. 3. Corresponding elements in FIGS. 1 and 3 have the same reference numerals and will not again be described. Here the ignition signal is furnished by a unit 10 which includes an ignition time calculator 100. Calculator 100 furnishes a signal at the beginning and the end of the computed desired closing time for switch 13. The first of these signals sets a JK flip-flop 101, while the second resets it. A signal A is therefore created at the output of flip-flop 100 which corresponds to signal A in FIG. 1. The K input of flip-flop 101 is connected to K input of flip-flop 24. The output of flip-flop 24 is directly connected to the control input of switch 13. The output of flip-flop 101 is connected to the J input of flip-flop 24 through an AND gate 40. Comparator 18 is included in unit 19, whose output is connected to the up/down control input of counter 21. The signal G at the output of current limiter 19 is the signal at the output of a threshold stage contained in any case in current limiter 19. This threshold stage furnishes a "0" signal when the current in the ignition coil has reached the required value.

One input of an OR gate 28 is connected to the output of inverter 27, while another input is connected to the output of an AND gate 41, whose first input is connected to the direction control input U/D of counter 21 and whose second input is connected to the carry input M of counter 23. The latter is connected to the blocking input E of counter 23 as in FIG. 1. The set input of counter 23 is connected to the output of flip-flop 101. The counting outputs of counter 23 are connected to the counting inputs of a digital comparator 42. The comparator inputs of comparator 42 receive the number "Z," which is preferably hard wired. The output of comparator 42 is connected to the second input of AND gate 40.

A quiescent current shutoff 30–32 is not shown but could of course be added in this embodiment also. The same is true of comparator 25 which blocks the second counter 23 at low engine speeds.

Figure 4:
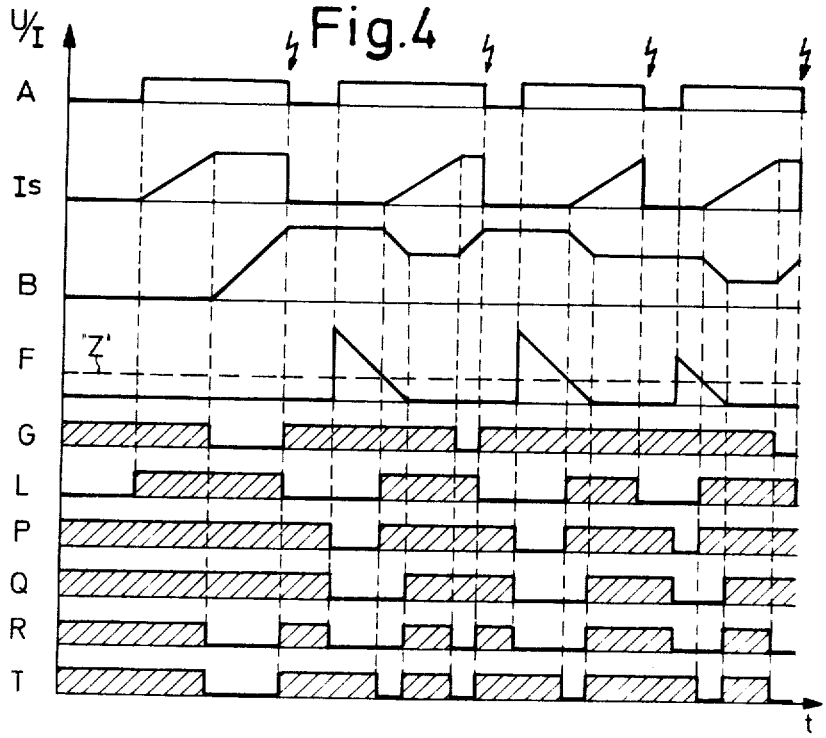
FIG. 4 shows the signal variation with respect to time at various points in the circuit of FIG. 3.

At the start of signal A both counters 21 and 23 are blocked. Counter 23 is blocked over its carry output M and counter 21 is blocked by the signal applied through AND gate 41 and OR gate 28 to its blocking input. When the current in the ignition coil reaches its required value, the current limiter circuit 19 starts its limiting action. Simultaneously, the signal G changes from a "1" signal to a "0" signal, allowing the first counter 21 to count. Since a "0" signal is present at its U/D input counter 21 begins to count in the up direction until ignition takes place. At this point the counter is again blocked by the signal received from inverter 27 through OR gate 28. At the start of the next signal A, counter 23 is set to the then-present count on counter 21 and starts to count down. When the Z value to which comparator 42 is set is reached, an output signal P causes flip-flop 24 to be set through AND gate 40. Switch 13 becomes conductive. Counter 21 is again enabled through inverter 27 and OR gate 28 and begins to count down, since the signal G is a "1" signal at this time. The count down continues until the lowest count on counter 23 is reached and its overflow signal blocks both counters. The blocking of counter 21 is again removed when the current in the ignition coil reaches the required value for ignition, which causes the signal G to change from a "1" signal to a "0" signal. The count in counter 21 at ignition time is a measure of the subsequent closing time of switch 13 as it was in the first embodiment. The less the count on counter 21, the longer the closing time and the less the open time of switch 13. Signals G,O,P,Q,R and T in FIG. 4 clearly illustrate the relationship between the signals at the inputs and outputs of the various units.

Some detailed circuit required for the reliable functioning of the system are not shown. For example, it may be advantageous to insert a delay flip-flop between the output of flip-flop 101 and the input of AND gate 40, thereby causing the signal to be delayed by one clock pulse. This prevents flip-flop 24 being set if the trailing edge of signal P coincides with the leading edge of signal A.

Figure 5:
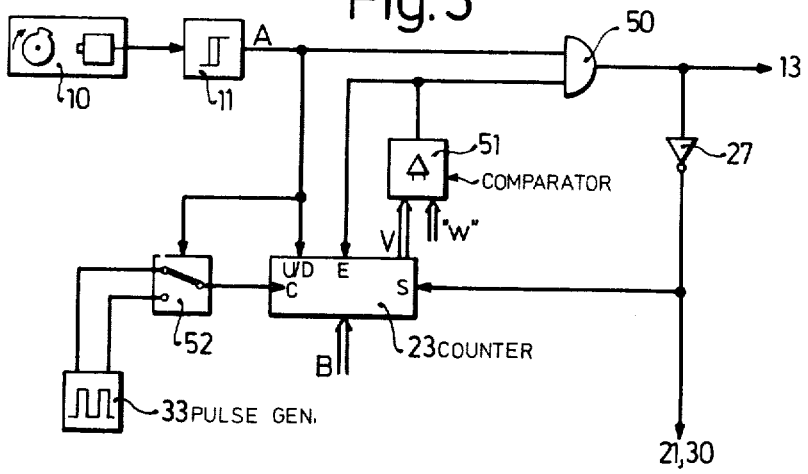
FIG. 5 is a circuit diagram of a third embodiment of the present invention.

The third embodiment shown in FIG. 5 corresponds in the main with the system shown in FIG. 1. Corresponding parts of the system are therefore not shown or described. The main difference between the two embodiments is in the control of counter 23. In FIG. 5, the output of pulse former 11 is connected through an AND gate 50 to the control electrode of switch 13. The output of AND gate 50 is connected through an inverter 27 to the set input S of counter 23. Counting inputs of counter 23 are connected to the counting ouputs of counter 21 as in the first embodiment. The counting outputs of counter 23 are connected to the inputs of a digital comparator 51. The reference inputs of comparator 51 receive the value W, again preferably by hard wiring. The output of digital comparator 51 is connected both to a further input of AND gate 50 and to the blocking input of counter 23. The output of pulse former 11 is connected both to the direction control input U/D of counter 23 and to the control input of a selection switch 52. Selection switch 52 may, for example, be a transmission gate. The counting input C of counter 23 is selectively connectable to two outputs of clock pulse generator 33 through selection switch 52. Each of the outputs furnishes a pulse sequence having a different repetition rate from the other. Digital comparator 52 may be replaced by other logic circuits which furnish a signal when the count on counter 23 has reached the value W.

Figure 6:
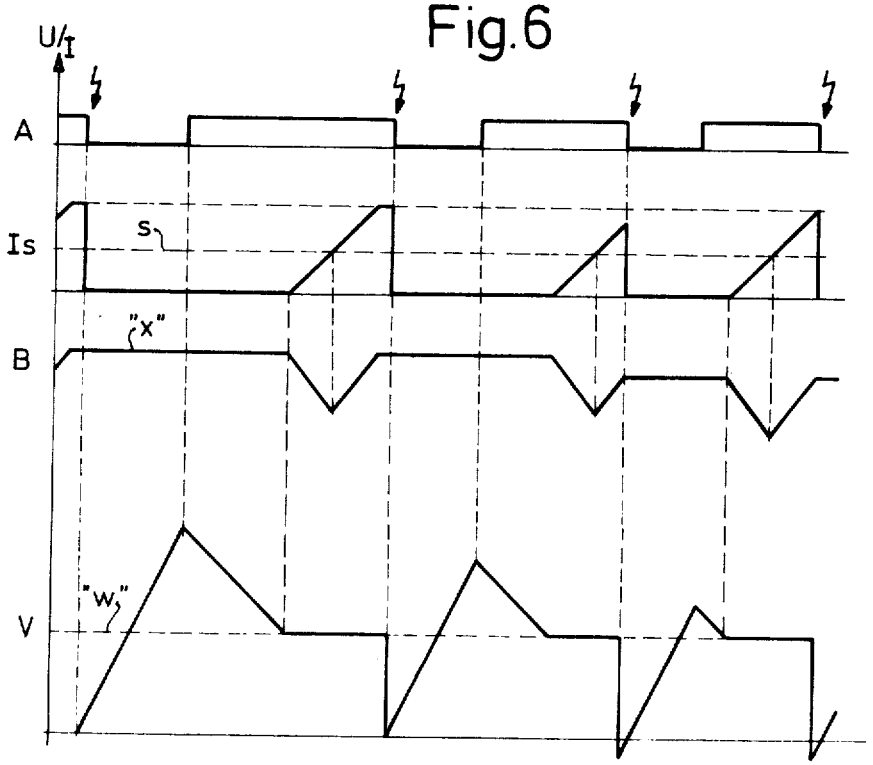
FIG. 6 is a diagram showing signal variation with respect to time at selected points in the circuit of FIG. 5.

The operation of above described FIG. 5 will be explained with reference also to the timing diagrams shown in FIG. 6. While the first embodiment operated to increase the closing time of switch 13, the second as well as the third embodiment cause a decrease in the closing time. In the embodiment shown in FIG. 5, the angle of closure specified by signal A is decreased in accordance with the then-present operating conditions to decrease the losses in the system without impairing the proper ignition.

As in the first embodiment, the count on counter 21 is transferred to counter 23 at the ignition time. During the subsequent absence of signal A counter 23 counts in the up direction; selection switch 52 connects counter 23 to the higher counting frequency furnished by clock generator 33. At the beginning of the next signal A counter 23 is switch to count in the down direction and its counting input C is supplied with the lower frequency by the switching of switch 52. In the example shown in FIGS. 5 and 6, the frequency, or pulse duty ratio, is two to one. The counter counts in the down direction until the value W set at comparator 51 is reached. The output from comparator 51 then blocks counter 23 and further generates a "1" signal at the output of AND gate 50 which causes switch 13 to close. Switch 13 remains closed until the trailing edge of signal A, since at that time the second input to AND gate 50 changes from a "1" to a "0" signal. Again, counter 21 counted first in the down and then in the up direction while the current in ignition coil 15 increased. An accelleration process is again shown in FIG. 6, that is both the signals A and the intervals between these signals become shorter. Thus, counter 21 does not reach its "x" value in the second cycle so that the count transferred to counter 23 is a lower number causing the switch 13 to close at an earlier time. Since the resulting angle of closure depends not only upon the pulse duty ratio of signal A but also on the value of the current in the ignition coil at the ignition time, the dynamic operation of the system is good without sacrifice of the advantages offered by the other method of increasing the closure angle. The actual closure time of switch 13 is determined mainly by counter 23. Counter 21 serves only to compensate for changes in battery voltage, variations in the pulse duty ratio, etc.

Other embodiments of the invention will readily come to mind. For example the count on counter 21,,instead of being transferred to counter 23 at the ignition time could be used to change the value W applied to comparator 51. This application would have to be in the inverse sense, that is a smaller count on counter 21 at ignition time would have to result in a large value W, in order to cause the earlier closure of switch 13.

The invention further is not to be restricted to counters with the specified counting directions. For example a count down process can be replaced by an upward count up to a particular threshold value or by a counting between two threshold values. Further, down/up counts can always be substituted for up/down counts.

Further, the present invention could be embodied in analog circuits. For analog embodiments the storages would be capacitors, clock pulse generators would be replaced by current sources, blocking inputs by blocking transistors and digital comparators by analog comparators.

We claim:

1. In an ignition system having
spark creating means (14, 17),
and controllable switch means (13) connected to said spark creating means for permitting and blocking current flow through said spark creating means when in a first and second state respectively,
and means (10) for furnishing a sequence of first ignition signals, each for timing the furnishing of a spark,
an ignition control system comprising, in accordance with this invention, means (12) for switching said controllable switch means to said second state under control of said first ignition signals;
first storage means (21) for furnishing a first storage signal representative of a predetermined count;
first storage signal changing means (28, 29, 18, 33) for changing said first storage signal in a first direction for a predetermined time period and in a second direction opposite to said first direction for a time period corresponding to the time the current in said spark creating means exceeds a predetermined threshold value, thereby creating a current-depending modified first storage signal;

a second storage means (23);

transfer means (25, 26) for transferring said current-dependent modified first storage signal to said second storage means under control of said first ignition signal, thereby creating a current-depending second storage signal;

second storage signal changing means connected to said second storage means and continuously changing said second storage signal in a predetermined direction;

and switch control means (24) connected to and controlled by said second storage means and further connected for switching said controllable switch means (13) back to said first state when said second storage signal reaches a predetermined threshold value.

2. A system as set forth in claim 1, wherein said first and second storage means respectively comprises a first and second digital counter (21, 23) each having a counting input (C), and clock pulse generator means (33) connected to said counting input for furnishing a sequence of clock pulses to said counting inputs, whereby the repetition frequency of pulses in said sequence of clock pulses determines the counting rate of said first and second digital counters.

3. A system as set forth in claim 2, wherein said first storage signal changing means comprises means for changing said first storage signal in a first direction from a first time instant determined by the start of current flow in said spark creating means to a second time instant when said current in said spark creating means reaches a predetermined current threshold value, and in a second direction opposite said first direction from said second time instant until interruption of current in said spark creating means.

4. Apparatus as set forth in claim 3, wherein said first storage signal changing means comprises current measuring means (16) connected to said spark creating means for furnishing a measured signal corresponding to the amplitude of current flowing in said spark creating means, and first comparator means (18) for comparing said measured signal to said predetermined current threshold value and furnishing a first comparator output signal upon correspondence therebetween, and means for applying said first comparator output signal to said first digital counter for changing the counting direction thereof.

5. A system as set forth in claim 4, wherein said first digital counter is a up/down counter having an up/-down control input;

and wherein said means for applying said first comparator output signal to said first digital counter comprises means for applying said first comparator output signal to said up/down control input of said first digital counter.

6. A system as set forth in claim 5, further comprising means (22), for presetting said first digital counter to the predetermined count upon activation of said system.

7. A system as set forth in claim 2, wherein said second digital counter is a down counter (23);

wherein said transfer means comprise means for transferring said current-dependent modified first stored signal from said first digital counter (21) to said second digital counter (23) under control of said ignition signal;

and wherein said switch control means comprises means for switching said controllable switch means back to said first state when the count on said second digital counter reaches a predetermined count.

8. A system as set forth in claim 1, further comprising current limiter means (19) connected to said spark creating means for limiting said current through said spark creating means to a predetermined maximum value.

9. A system as set forth in claim 1, wherein said predetermined time period is the time required for said second storage signal to change from a first to a second predetermined value;

and wherein said time period for changing the contents of said first storage means in said second direction is the time period starting with the time instant at which said current in said spark creating means exceeds said predetermined threshold value and ending upon interruption of said current in said spark creating means in response to said first ignition signal.

10. A system as set forth in claim 9, wherein said first storage signal changing means comprises current measuring means for furnishing a measured signal corresponding to the amplitude of said current in said spark creating means, and threshold circuit means (19) connected to said current measuring means for furnishing a threshold output signal when said current in said spark creating means has reached a predetermined current.

11. A system as set forth in claim 10, further comprising current limiter means (19) connected to said spark creating means for limiting the current therethrough;

and wherein said threshold circuit means is part of said current limiting means.

12. A system as set forth in claim 10, wherein said first storage means comprises a first digital counter;

wherein said first digital counter is an up/down counter;

further comprising means for connecting said threshold circuit means to said up/down counter to determine the counting direction thereof.

13. A system as set forth in claim 12, wherein said switch control means further comprises digital comparator means (42, 51) connected to said second storage means, for furnishing a second comparator output signal when said second storage signal reaches a predetermined threshold value, and logic circuit means (40, 24; 50) responsive to said second comparator output signal for switching said controllable switch means back to said first state.

14. A system as set forth in claim 13, wherein said logic circuit means comprises means for switching said controllable switch means back to said first state only in the simultaneous present of said ignition signal and said second comparator output signal.

15. A system as set forth in claim 14, wherein said second storage means comprises a second digital counter;

and wherein said predetermined time interval wherein said first storage signal changing means changes said first storage signal in a first direction correspondence to the time the count on said second digital counter changes from a first to a second predetermined count.

16. A system as set forth in claim 15, wherein said first storage signal furnishing means comprises additional logic circuit means (41, 28) interconnected between said first and second storage means.

17. A system as set forth in claim 1, wherein said ignition signal furnishing means further furnishes an auxiliary ignition signal;

wherein said second storage signal changing means comprises means for changing said second storage signal in a first direction until receipt of said auxiliary ignition signal and in a second direction opposite said first direction until said second storage signal has reached a predetermined second storage signal value, said predetermined second storage signal value constituting said predetermined threshold value for operating said switch control means.

18. A system as set forth in claim 17, wherein said second storage means comprises a second digital counter;

and wherein said second storage signal changing means comprises means for changing the count on said digital counter.

19. A system as set forth in claim 18, wherein said means for changing said count on said second digital counter comprises means for changing the count on said digital counter at a first frequency when counting in said first direction and at a second frequency when counting in said second direction.

20. A system as set forth in claim 19, wherein said ignition signal furnishing means comprises means for furnishing a sequence of pulses each having a first edge constituting said ignition signal and a second edge constituting said auxiliary ignition signal, said pulse sequence having a predetermined pulse duty ratio;

and wherein the ratio of said first to said second frequency corresponds to said pulse duty ratio.

21. A system as set forth in claim 1, wherein said transfer means comprises blocking circuit means (25) for blocking the transfer of said first storage signal to said second storage means if said first storage signal has a predetermined value when said ignition signal is furnished by said ignition signal furnishing means.

22. A system as set forth in claim 21, wherein said blocking circuit means comprises a comparator having a first input connected to said first storage means, a second input for receiving a reference signal and an output connected to the set input of said second storage means.

23. A system as set forth in claim 1, wherein said ignition signal furnishing means further furnishes an auxiliary ignition signal;

and wherein said switch control means comprises means responsive to said auxiliary ignition signal or said predetermined threshold value of said second storage means for switching said controllable switch means back to said first state, thereby assuring a minimum time wherein said controllable switch means is in said second state.

24. A system as set forth in claim 1, further comprising third storage means (30) for furnishing a third stored signal;

means for resetting said third storage means in response to each of said ignition signals;

means for changing said third stored signal continuously during current flow in said spark creating means;

comparator means connected to said third storage means for furnishing a comparator output signal when said third stored signal is a predetermined third stored signal;

and means for blocking said current in said spark creating means upon receipt of said comparator output signal.

25. A system as set forth in claim 1, wherein said system is embodied in an integrated circuit block.

26. In an ignition system of an internal combustion engine having a spark plug (7);

an ignition coil (15) having a secondary winding connected to said spark plug and a primary winding;

an output transistor (13) having an emitter-collector circuit connected in series with said primary winding of said ignition coil and adapted for connection to;

a source of d-c voltage;

and ignition signal furnishing means (10,11) for furnishing a sequence of pulses each having a pulse width corresponding to a predetermined angle of rotation of said internal combustion engine and for applying said ignition pulses to said output transistor in such a manner that said emitter-collector circuit is conductive and non-conductive in the presence and absence of said pulses respectively;

an ignition current control system for advancing the time said output transistor is switched to said conductive state when the primary current in said ignition coil is less than a predetermined minimum value required for ignition at the ignition time and for retarding the time said output transistor is switched to said conductive state when said primary current exceeds said predetermined minimum value prior to ignition, comprising a first digital counter (21) for furnishing a first counting signal corresponding to a count thereon;

first counting signal changing means (28, 29, 18, 33) for changing the count in said first digital counter in a first direction for a predetermined time period and in a second direction opposite to said first direction for a time period corresponding to the time said primary current exceeds a predetermined threshold value in such a manner that the count on said first counter varies as a function of the length of time said primary current exceeded said predetermined minimum value prior to the ignition time or varies as a function of the amplitude of said primary current if said primary current is less than said predetermined value at said ignition time;

a second digital counter (23) connected to said first digital counter;

transfer means (25, 26) for transferring said first counting signal to said second digital counter upon receipt of said ignition signal, thereby creating a second counting signal;

second counting signal changing means changing said second counting signal in a predetermined direction;

and switch control means (24) connected to said second digital counter for switching said output transistor to the conductive state when said second counting signal signifies a predetermined second count.

* * * * *